United States Patent [19]

Hall

[11] Patent Number: 4,634,120

[45] Date of Patent: Jan. 6, 1987

[54] LOCATOR PLUG FOR GROUND ANCHOR

[76] Inventor: Roger E. Hall, 2 Rainbow Cir., Elizabethtown, Pa. 17022

[21] Appl. No.: 656,706

[22] Filed: Oct. 1, 1984

Related U.S. Application Data

[63] Continuation of Ser. No. 647,534, Sep. 5, 1984.

[51] Int. Cl.[4] ..... A63B 71/00

[52] U.S. Cl. ..... 273/25; 52/165

[58] Field of Search ..... 273/34 R, 34 A, 34 D, 273/162 D, 25; 215/11 C, 211; 52/165, 166, 309.1

[56] References Cited

U.S. PATENT DOCUMENTS 2,225,496 12/1940 Gethlin ..... 273/25

3,244,305 4/1966 Moore ..... 215/11 C

*Primary Examiner*—Richard C. Pinkham

*Assistant Examiner*—T. Brown

*Attorney, Agent, or Firm*—Kerkam, Stowell, Kondracki & Clarke

[57] ABSTRACT

A ground anchor locator plug is specifically constructed to avoid being damaged by field dragging equipment. The locator plug, which is made of elastomeric material, has an annular ridge which surrounds an annular dirt-retaining recess in which a locator pin is disposed. The recess retains dirt to prevent the plug from being overly obtrusive upon a ball field.

20 Claims, 8 Drawing Figures

(PRIOR ART PLUG)

LOCATOR PLUG FOR GROUND ANCHOR

CROSS REFERENCE TO RELATED APPLICATION

The present application is a continuation-in-part of the present inventor's co-pending application entitled "Safety Base With Anchor, Methods of Using and Making, and Associated Tool", Ser. No. 647,534 filed Sept. 5, 1984. That application is hereby incorporated by reference.

BACKGROUND OF THE INVENTION

This invention relates to locator plugs. More specifically, this invention relates to locator plugs as used with ground anchor systems.

The use of various ground anchors has been relatively common. In particular, ground anchors are used for securing various above-ground structures to the ground. The above-ground structures secured by use of ground anchors buried within the ground include fence posts, marker poles or posts, and bases used for playing baseball or similar sports.

Ground anchors often pose a problem when the above-ground structure is removed from the ground anchor. Specifically, if a baseball base is moved from its ground anchor, a person falling upon the ground anchor may be injured. Even though the ground anchor is at least partially below the dirt, it often includes a metallic tube which may be hazardous.

It should be noted that baseball or softball fields are often used for different levels of play. For example, a youth league may play baseball on the field with sixty feet in between bases, whereas a high school or college team might use the same field with ninety feet in between the bases. Such a field would thus have ground anchors corresponding to sixty feet in between the bases as well as ground anchors corresponding to ninety feet in between the bases. When the field is changed by removing bases from the youth league ground anchors (sixty feet separation distance) and placing bases on the high school or college ground anchors (ninety feet separation), it is necessary to cover the youth league ground anchors. In particular, a resilient plug made of rubber or other elastomeric material has been used for protecting an athlete from the metallic tube of the ground anchor. Additionally, the rubber plug serves to prevent dirt from getting into the receiving tube. Further, the rubber plug serves as a locator to allow one to easily locate the youth league ground anchors.

Although various prior art ground anchor locator plugs have been generally useful, they have often been subject to at least two distinct disadvantages. First, such locator plugs often have a tendency to let dirt wash away from the locator plug, thus making the locator plug more exposed and increasing the possibility that the plug will get in the way of baseball players. Further, the increased exposure of the plug may cause problems for maintenance crews. Second, prior art locator plugs are often easily damaged by equipment commonly used upon a ball field. In particular, a drag having an angle iron with steel teeth is used commonly for raking or smoothing off a ball field. However, the drag often damages the prior art locator plugs. The tendency of the prior art locator plug to allow dirt to wash away from it increases the liklihood of the plug being damaged by the drag or being pulled out of the ground by the drag.

OBJECTS AND SUMMARY OF THE INVENTION

Accordingly, it is a primary object of the present invention to provide a new and improved ground anchor locator plug.

A more specific object of the present invention is to provide a ground anchor locator plug which has a tendency to retain dirt.

Another object of the present invention is to provide a ground anchor locator plug which is shaped to minimize the liklihood of it being damaged or pulled loose by field dragging tools or other type of equipment.

The above and other objects of the present invention which will become apparent as the discription proceeds are realized by a ground anchor locator plug comprising a shaft and a head, the head having a top surface with an upwardly extending locating pin and a dirt-retaining recess surrounding the pin, and wherein the locator plug is adapted for placement with its shaft in a buried ground anchor with the pin extending out of the ground such that the recess is operable to receive and retain dirt. The plug is made of elastomeric material. The top surface has 360° of symmetry and includes a circular outer edge. The top surface includes an outer surface portion extending up and inwardly to a ridge, and wherein the recess is disposed inward from the ridge. The outer surface portion includes an outer part end and inner part, the inner part having a greater slope than the outer part. The top surface is operable to prevent ground dragging tools from catching on the pin. The shaft is square in cross section and the plug is adapted for placement in a base ground anchor.

The present invention may alternately be described as a ground anchor locator plug comprising a shaft and a head, the head having a top surface with an outer surface portion sloping up and inwardly to a central area, the central area having a part with an inward slope less than or equal to zero, the top surface further having an upwardly extending locating pin within the central area, and wherein the change in slope from the outer surface portion to the part of the central area prevents ground dragging tools from catching on the pin, and wherein the locator plug is adapted for placement with its shaft in a buried ground anchor with the pin extending up and out of the ground. The central area includes a dirt retaining recess surrounding the pin. The recess is operable to receive and retain dirt around the pin.

BRIEF DESCRIPTION OF THE DRAWINGS

The above and other features of the present invention will be more readily apparent when the following detailed description is considered in conjunction with the accompanying drawings wherein like characters represent like parts throughout the several views and in which.

DETAILED DESCRIPTION

Figure 1:
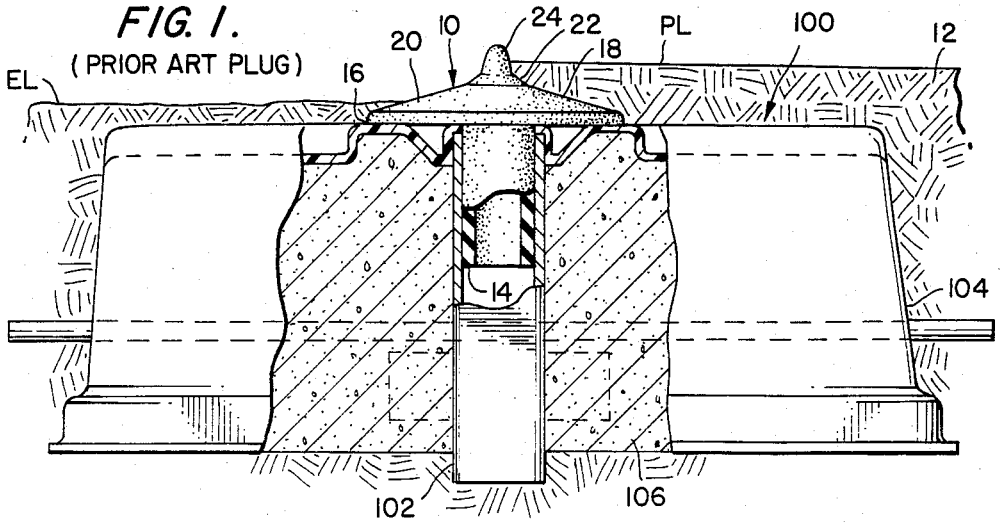
FIG. 1 shows a prior art locator plug disposed within a ground anchor as disclosed and claimed in the incorporated by reference parent patent application, with parts being shown in cross section.

With reference now to FIG. 1, the general characteristics of a prior art locator plug 10 will be discussed. The plug 10 is shown placed within a ground anchor 100 which includes a square cross section hollow metallic receiving tube 102, a housing 104, and concrete 106. The ground anchor 100, which is disclosed in detail and claimed in the incorporated by reference parent application, is shown for illustrative purposes only. It should be understood that only the locator plug 10 is conceded to be prior art. Those parts labeled with numbers below 100 are parts of the prior art plug 10, whereas generally corresponding parts, if any, labeled 110 or above have the same last two digits as the generally corresponding part of prior art plug 10.

As shown in FIG. 1, the prior art plug 10 may be placed within the metallic receiving tube 102 so as to minimize the risk of player injury by falling upon the metallic tube 102. Further, the plug 10 keeps dirt out of the metallic receiving tube 102 and allows persons to easily locate the buried ground anchor 100. Although the prior art plug 10 and the plug of the present invention will be specifically discussed as used with the ground anchor 100, it should be appreciated that either of the plugs might be used with various prior art ground anchors.

The ground 12 is shown at a preferred level PL on the right side of FIG. 1 and at an eroded level EL on the left side of FIG. 1 for illustrative purposes. In particular, the preferred level PL represents the ground level which the dirt 12 should be placed at following insertion of the shaft 14 of plug 10 within the metallic receiving tube 102. The eroded level EL represents a lower level to which the dirt may assume following rain, wind, or repeated athletic competition upon the field.

Figure 3:
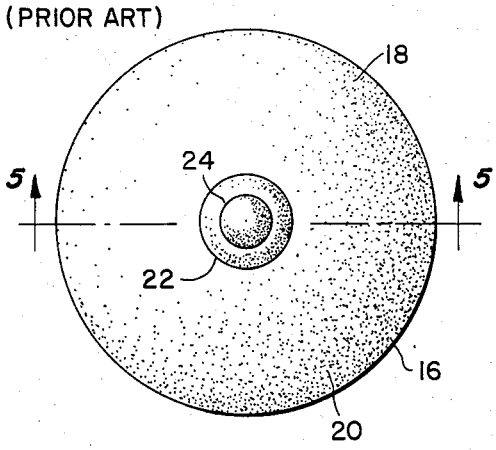
FIG. 3. (PRIOR ART)
FIG. 3 shows a top view of the prior art locator plug.
Figure 4:
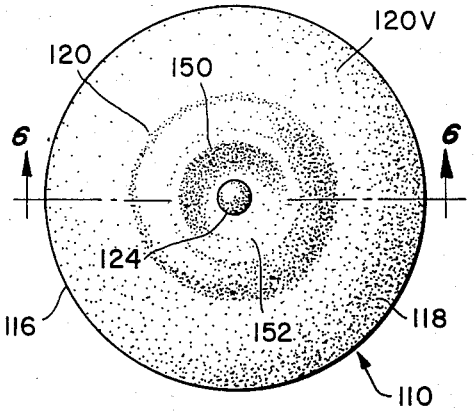
FIG. 4 shows a top view of the locator plug of the present invention.
Figure 5:
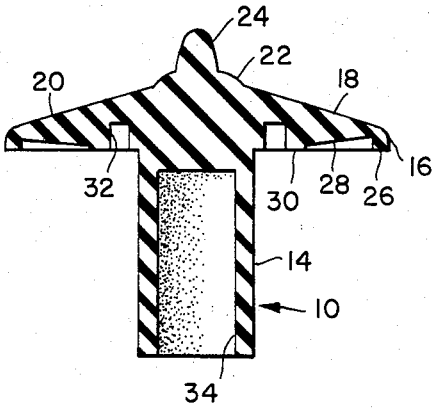
FIG. 5. (PRIOR ART)
FIG. 5 shows a cross section view along lines 5—5 of the prior art plug of FIG. 3.
Figure 7:
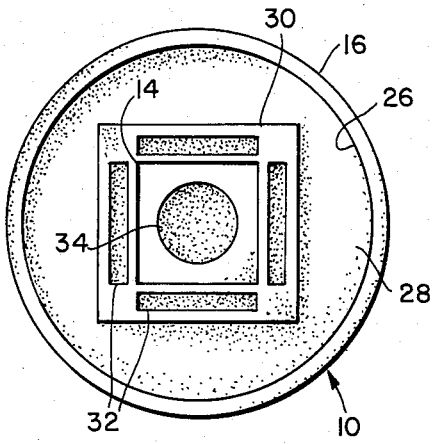
FIG. 7. (PRIOR ART)
FIG. 7 shows a bottom view of the prior art locator plug.

Considering now FIG. 1 in conjunction with FIGS. 3, 5, and 7, the details of construction of the prior art plug 10 will be discussed. In particular, the plug is made of rubber or other elastomeric material. The locator plug 10 includes a shaft 14 and a head 18 having a circular outer edge 16. The top surface of the head 18 includes an inwardly and upwardly extending outer portion 20, and intermediate portion 22, and a locator pin 24. The lower surface of the head 18 includes an outer portion 26 which projects downwardly as best shown in FIG. 5, a recessed portion 28, a central portion 30, and four strip recesses 32 disposed just outside of the square shaft 14. The shaft 14 has a circular hole 34 extending axially therein. The hole 34 facilitates insertion of the prior art plug 10 into a receiving tube such as tube 102 in ground anchor 100.

One problem with the prior art plug 10 is that use of a field dragging tool may shear off the locating pin 24. In particular, the dragging equipment may iclude an angle iron with steel teeth which are dragged upon the ground. Because the locating pin 24 protrudes from the plug 10, the drag or dragging tool (not shown) directly contacts the bottom part of locator pin 24 and often damages the pin.

Although damage to the locating pin 24 may occur even when the ground 12 is at its preferred level PL, such damage is especially likely to occur after the ground has been eroded to a level such as EL shown in the left side of FIG. 1.

Figure 2:
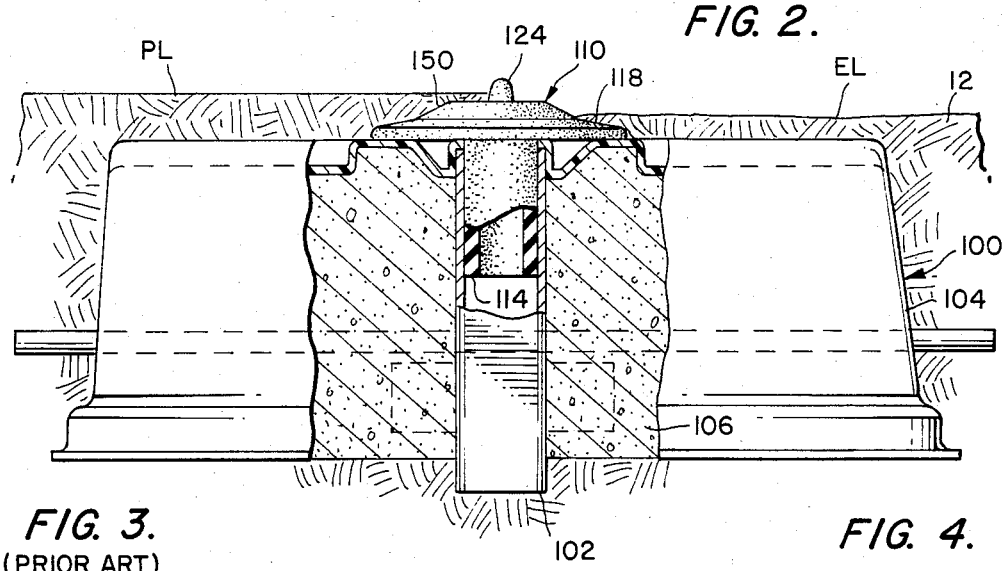
FIG. 2 shows a side view of the locator plug of the present invention as placed within a ground anchor with parts shown in cross section.

Turning now to FIGS. 2, 4, 6 and 8, a locator plug 110 in accordance with the present invention will be discussed. As shown in FIG. 2, the locator plug 110 may be used with the ground anchor 100.

Figure 8:
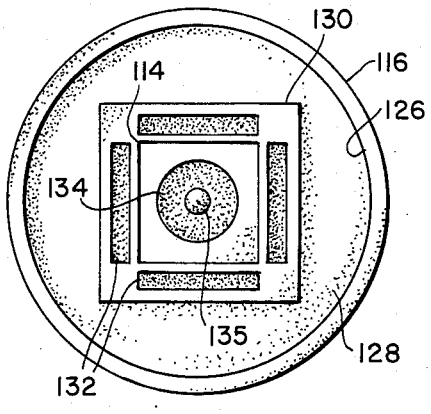
FIG. 8 shows a bottom view of the locator plug of the present invention.

The locator plug 110 includes a shaft 114 and a head 118. As best shown in FIG. 8, the bottom of the head 118 and the shaft 114 essentially correspond to the similar parts of the plug 10 except that a recess 135 may be disposed within the hole 134. However, the top surface of the head 118 is significantly improved over the top surface of the head 18 of prior art plug 10. In particular, the top surface of head 118 has an outer surface portion comprising an outer part 120U and an inner part 120I. (As used herein, "inner" means closer to the center of the plug, whereas "outer" means further from the center of the plug.) Disposed at the inner edge of inner part 120I of the outer surface portion comprised of parts 120U and 120I is an annular ridge 150. Just inside of the annular ridge 150 is a central area having a dirt-retaining annular recess 152, which surrounds the locator pin 124 extending upwardly therefrom. As will be readily appreciated from FIG. 6, the central part including recess 152 has a part with an inward slope less than or equal to zero. As additionally shown by FIG. 6, the slope of inner part 120I is greater than the slope of outer part 120U, the latter part being adjacent circular edge 116. The "slope" may be considered as the tangent of "rise" over inwardly extending "run" for a diametrical cross section similar to the cross section of FIG. 6.

Figure 6:
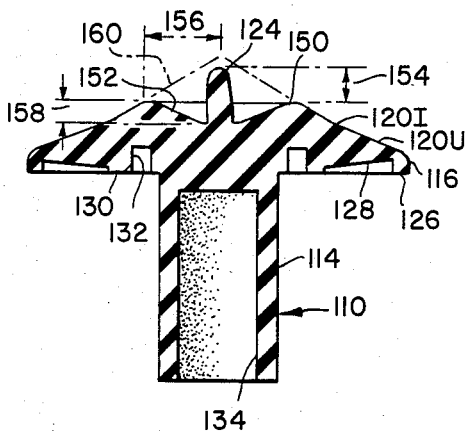
FIG. 6 shows a cross section view along lines 6—6 of FIG. 4.

As shown in FIG. 6, the shape of the inner part 120I is such that the tangent of rise of an imaginary line 160 extending from the surface of the slope of the inner part terminates at a common point above the pin 124.

The overall operation of the locator plug 110 is generally similar to that of the plug 10. That is, the plug 110 may be placed within a ground anchor 100 following removal of the base (not shown). When the shaft 114 of locator plug 110 is placed within the metallic tube 102, the plug 110 will minimize the liklihood of injury to a person falling upon the ground above metallic tube 102. Additionally, the plug 110 will minimize dirt getting into the tube 102 as well as serving as a locator for the ground anchor 100. However, the plug 110 is quite improved over the prior art plug 10 in that the central area recessed portion 152 allows the locator pin 124 to "hide" from the field dragging tools commonly used on ball fields. In particular, when the dirt is at the preferred level PL shown on the left of FIG. 2, the drag tool will simply jump over or bounce off the top of the pin 124 which may bend slightly to be within the recess 152 (see especially FIGS. 2 and 6). The annular ridge 150 in combination with the recess 152 will prevent the drag from contacting or catching onto the bottom of the pin 124. Thus, the top surface of the head 118 is shaped to prevent ground dragging tools from catching and/or shearing the pin 124. Further, the ridge 150 and the annular recess 152 will prevent the dragging equipment from pulling the locator plug 110 out from the ground, whereas prior art designs including that shown in FIGS. 1, 3, 5, and 7 have often had this problem.

The annular recess 152 is a dirt-retaining recess and is operable to receive and retain dirt. The prior art plug 10 had the tendency to let dirt wash away from the locator making more of the plug exposed. The dirt-retaining annular recess 152 tends to lessen the exposure and, thus, the obtrusiveness of the plug 110.

If, in spite of the dirt-retaining feature of recess 152, the ground or dirt is eroded to level EL on the right side of FIG. 2, the annular ridge 150 and recess 152 will allow drag tools to jump over the pin 124 or simply bump off the top of pin 124. With particular reference to FIG. 6, a drag tool moved across the plug 110 will tend to continue along line 160 which is an imaginary line extension of part 120I. Thus, the drag tool will either miss the locator pin 124 or simply brush against its top. The annular ridge 150 prevents the drag tool from hitting the locator pin 124 at its lower end.

The material used for the plug 110 is preferably compression molded latex rubber of about 45 durometer. The diameter at edge 116 is preferably 5 inches, whereas the dimensions shown in FIG. 6 are about: 7/16 inches for 154, 1 inch for 156, and ¼ inch for 158. Preferred ranges are 3/16 to 1 inch for 154, ½ to 1½ inches for 156, and ⅛ to ¾ inches for 158.

Although various specifics have been described herein, it is to be understood that these are for illustrative purposes only. Various modifications and adaptations will be readily apparent to those of ordinary skill in the art. Accordingly, the scope of the present invention should be determined by reference to the claims dependent hereto.

What is claimed is:

1. A locator plug for a ground anchor comprising a substantially solid head means and a depending shaft means; said head means having a bottom surface extending outwardly from the shaft member to provide a horizontal support surface and a top surface with an upwardly extending locating pin means and a central region having an upward extending ridge on said top surface adjacent said pin, the uppermost extension of said pin being greater than the uppermost extension of said ridge so as to form a recess surrounding said pin interior of said ridge, and wherein said locator plug is adapted for placement with its shaft means in a buried ground anchor with said support surface resting on the ground anchor, said top surface and recess covered with dirt and said pin extending out of the dirt such that said pin means is operable to serve as a position locator for said ground anchor.

2. The locator plug of claim 1 wherein said plug is an elastomeric material.

3. The locator plug of claim 2 wherein said top surface has 360 degrees of symmetry and includes a circular outer edge and said ridge is annular and surrounds said pin.

4. The locator plug of claim 2 wherein said outer surface includes an outer part and an inner part, said inner part having a greater slope than said outer part.

5. The locator plug of claim 2 wherein the bottom surface has a diamter substantially greater than that of the central region.

6. The locator plug of claim 5 wherein the diameter of the bottom surface is approximately 5 inches and the diameter of the central region is between 1 inch and 3 inches.

7. The locator plug of claim 6 wherein the height of the pin is between 5/16 inch and 1¾ inches.

8. The locator plug of claim 6 wherein the height of said ridge is between ⅛ inch and ¾ inch.

9. The locator plug of claim 1 wherein said top surface includes a continuous sloping surface including an outer part and an inner part, said inner part having a greater slope than said outer part.

10. The locator plug of claim 9 wherein said plug is an elastomeric material.

11. The locator plug of claim 9 wherein the slope of the inner part is such that the tangent of rise of an imaginary line extending from the surface of the slope of the inner part terminates at a common point above the pin.

12. A locator plug for a ground anchor comprising a head means and a depending shaft means, said head means having a bottom surface extending outwardly from the shaft to provide horizontal support surface and a top surface with an outer surface sloping upwardly and inwardly to a central area, said top surface further having an upwardly extending locating pin means within said central area, and said upwardly sloping surface having a first slope and a second slope different from said first slope, the change in slope from said first slope to said second slope providing a rise which minimizes ground dragging tools from catching on said pin when said locator plug is placed with its shaft in a buried ground anchor with said pin means extending out of the ground to permit location of the ground anchor.

13. A locator plug of claim 12 wherein said plug is an elastomeric material.

14. The locator plug of claim 12 wherein said greater second slope is greater than said first slope.

15. The plug of claim 14 wherein said central area includes a dirt-retaining recess surrounding said pin.

16. The locator plug of claim 12 wherein said central area includes a dirt-retaining recess surrounding said pin.

17. The locator plug of claim 16 wherein said plug is an elastomeric material.

18. The locator plug of claim 12 wherein the slope of the second slope is such that the tangent of rise of an imaginary line extending from the surface of the slope of the inner part terminates at a common point above the pin.

19. The locator plug of claim 18 wherein the bottom surface has a diameter substantially greater than that of the central area.

20. The locator plug of claim 12 wherein the head is a substantially solid elastomeric member and the shaft member is a cylindrical member open at a lower end and having a upwardly extending central opening terminating at the head.

* * * * *